US005218952A

United States Patent [19]

Neufeldt

[11] Patent Number: 5,218,952

[45] Date of Patent: Jun. 15, 1993

[54] RADIANT HEATING APPARATUS

[76] Inventor: Allen A. Neufeldt, 85 Nymark Avenue, Willowdale, Ontario, Canada, M2J 2H1

[21] Appl. No.: 949,269

[22] Filed: Aug. 14, 1992

Related U.S. Application Data

[63] Continuation of Ser. No. 783,222, Oct. 28, 1991, abandoned.

[30] Foreign Application Priority Data

Oct. 29, 1990 [CA] Canada ..... 2028781

[51] Int. Cl.[5] ..... F24C 3/04

[52] U.S. Cl. ..... 126/92 AC; 126/92 R; 431/326; 431/328; 137/514.7

[58] Field of Search ..... 126/92 AC, 92 R, 91 A; 431/326, 328; 137/514.7; 123/527

[56] References Cited

U.S. PATENT DOCUMENTS 3,248,099 4/1966 Bratko ..... 431/329 X
4,189,297 2/1980 Bratko et al. ..... 431/328
4,614,168 9/1986 Batchlor ..... 123/527 X
4,927,355 5/1990 Haire et al. ..... 431/329

OTHER PUBLICATIONS

"Gas Combustion System Comparator Chart" Source and Date unknown.

*Primary Examiner*—Larry Jones

[57] ABSTRACT

This invention describes a radiant heating unit, which can be used with a scarifier or patcher. The heating unit system is comprised of a supply means used for supplying a quantity of gaseous fuel at a predetermined pressure, a housing, and a layer of ceramic fiber with a mesh retaining layer on the upper and lower side thereof. A fuel-air mixture system is located in an upper aperture of the housing, which provides a combustible mixture to the housing chamber. This combustible mixture is eventually burnt at the bottom outer surface of the ceramic fiber layer to provide a hot radiant heating surface.

7 Claims, 1 Drawing Sheet

RADIANT HEATING APPARATUS

This application is a continuation of application Ser. No. 07/783,222, filed Oct. 28, 1991, now abandoned.

FIELD OF THE INVENTION

The present invention relates to an apparatus used to provide large quantities of radiant heat energy over a relatively large surface area. The radiant heating apparatus of the present invention can be used with roadway surface reconditioning machines such as scarifiers and patchers.

BACKGROUND OF THE INVENTION

The use of a radiant heating apparatus will be discussed in conjunction with scarifiers and patchers. However, the use of a radiant heater of the present invention is not limited to scarifiers and patchers.

The term "scarifier" denotes a machine that travels slowly along a roadway while heating the existing asphalt to a relatively high temperature. It then loosens the hot asphalt and finally smooths down the loosened hot material to form a reconditioned and resurfaced roadway.

The term "patcher" denotes a machine that heats a small area of asphalt to a relatively high temperature. The treated area is hand raked and finally rolled to produce a reconditioned patch of asphalt.

A critical component of scarifiers and patchers is the heater assembly for applying heat to the old roadway surface. It is desirable to apply as much heat as possible to the asphalt, and to do so as quickly as possible, because the amount of heat that can be transferred to the asphalt per unit time will determine how fast the machines can recondition a roadway surface. The efficiency of heat transfer will also determine the depth to which the asphalt can be heated.

The other major component of a radiant heating apparatus is the fuel-air supply system. This system supplies the necessary high pressure propane gas into the burner unit. It is important that the propane gas be supplied at a high pressure in order to produce a 100% premix of air and propane gas.

PRIOR ART

Prior art heating units used in scarifiers and patchers utilized a series of porous firebricks as the heater units. These bricks are designed so that a gaseous fuel consisting of a mixture of propane and air introduced into a hollow rear space can flow through the bricks and burn at or adjacent the surfaces thereof to provide a large area radiant heater. The entire heater unit is extremely heavy due to the large number of bricks used; as a result, fire brick systems require the use of heavy hydraulics to lift the heater units.

The brick heating units are also subject to frequent breakage when the machines are bumped against a curb etc. The cost of replacement bricks is substantial, and the labour to install them requires specialized skill. As a result, heating units that utilize firebricks are extremely expensive to operate and maintain.

In the past open flame burners have been used in heater units, which would overheat certain portions of asphalt. In addition, the open flames have also been blamed for starting fires among shrubs and other vegetation along the side of the road.

Prior art fuel-air supply systems required the use of high-powered blowers, for use in a porous brick heating unit, in order to adequately mix air with propane gas. These systems require many valves and regulators to ensure the air/gas mixture is adequate for obtaining a 100% premix.

SUMMARY OF THE INVENTION

The present invention relates to a radiant heating apparatus used to heat large surface areas to a high temperature. The radiant heating apparatus is comprised of a novel heater unit and a novel fuel supply system.

The fuel supply system that feeds the heater unit requires the use of a small pump and a vaporizer, or merely a vaporizer.

In accordance with an aspect of the invention there is provided a radiant heating unit comprising:

a) supply means for supplying a quantity of gaseous fuel at a predetermined pressure;

b) a housing having an open bottom, an upper chamber communicating with said open bottom, and an upper aperture communicating with said upper chamber;

c) a first mesh retaining means covering said open bottom;

d) a layer of ceramic fibre resting on said first mesh retaining means and substantially covering said open bottom, said layer of ceramic fibre having a bottom outer surface;

e) a second mesh retaining means coverings said open bottom and resting on said layer of ceramic fibre; and f) fuel-air mixture means located in said upper aperture and connected to said supply means for providing a combustible mixture to said upper chamber, said combustible mixture passing through said layer of ceramic fibre, and burning at said bottom outer surface of said layer of ceramic fibre.

In accordance with another aspect of the invention there is provided a fuel supply means for supplying a gaseous fuel at a predetermined pressure, said fuel supply means comprising:

a) a fuel tank for storing liquid fuel having a supply pipe and a return pipe;

b) a pump connected to said supply pipe;

c) a vaporizer having an input connected to said supply pipe and an output for gaseous fuel;

d) a by-pass valve connected between said supply line and said return line for controlling the pressure of the liquid fuel at a predetermined maximum at the input to said vaporizer; and e) a control regulator connected to the output of said vaporizer to control the pressure of the gaseous fuel to said predetermined pressure.

In accordance with another aspect of the invention there is provided a fuel supply means for supplying a gaseous fuel at a predetermined pressure, said fuel supply means comprising:

a) a fuel tank for storing liquid fuel having a supply pipe and a return pipe;

b) a vaporizer having an input connected to said supply pipe and an output for gaseous fuel;

c) a first control regulator connected between said output of said vaporizer and said return pipe of said fuel tank, wherein said first control regulator regulates the return flow of pressurized gaseous fuel to said fuel tank; and d) a second control regulator connected to the output of said vaporizer to control the pressure of the gaseous fuel to said predetermined pressure.

BRIEF DESCRIPTION OF THE DRAWINGS

The present invention will be described in detail hereinbelow with the aid of the accompanying drawings, in which.

DESCRIPTION OF THE PREFERRED EMBODIMENTS

Figure 1:
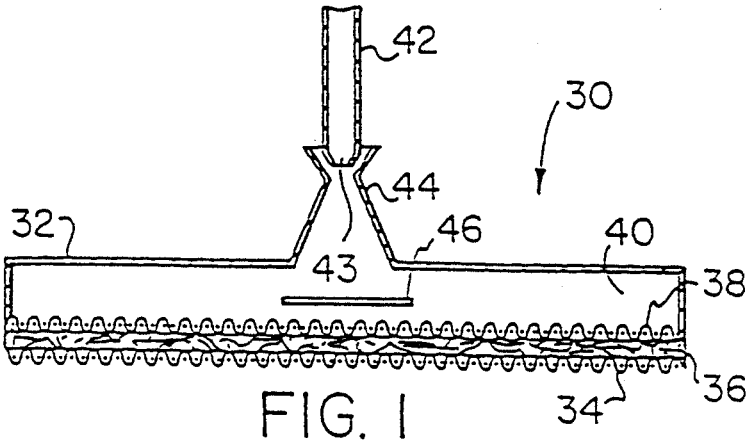
FIG. 1 illustrates a side view of a heater unit of a radiant heating apparatus.

FIG. 1 illustrates a radiant heating unit 30. The heater unit 30 consists of a steel frame 32 oriented above and attached to a first layer of steel mesh 34 and a layer of ceramic fibre material 36, such as Kaowool (TM). A second layer of steel mesh 38 is placed on top of ceramic fibre 36.

High pressure propane gas is fed by a supply line 42 through an orifice 43 into a venturi 44. The flow of high pressure gas, at a specific velocity, through the narrow portion of venturi 44 causes primary air to mix with the propane gas to produce a 100% combustible mixture. This mixture is deflected by a deflector plate 46 in chamber 40, which distributes the gaseous mixture evenly into ceramic fibre layer 36. The gaseous mixture is ignited at the bottom outer surface (at first layer 34) of ceramic fibre 36. The flow of the gaseous mixture cools the upper outer surface (at second layer 38) of ceramic fibre 36, which prevents the upper surface of fibre 36 from becoming excessively hot.

The ceramic fibre material 36 used as the infra-red combustion surface is very light, has low thermal conductivities, low heat storage and excellent resistance to thermal shock. For example, Kaowool (TM) brand of ceramic fibre has a much lower thermal conductivity than the commonly use Alumino-Silicate Firebrick. These characteristics ensure that the ceramic fibre can withstand extremely high temperatures for prolonged periods of time.

Figure 2:
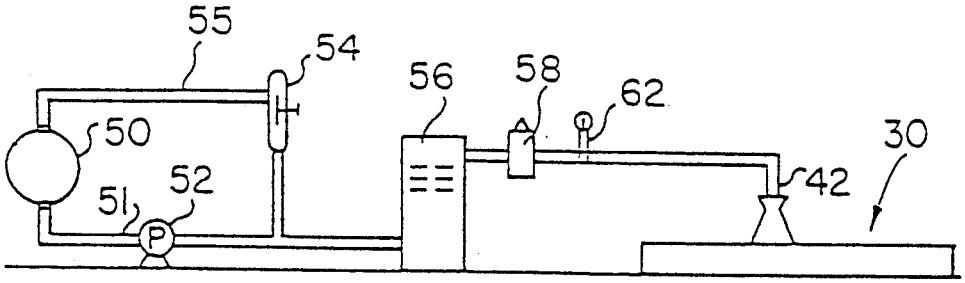
FIG. 2 is a schematic diagram of a first embodiment of a fuel supply system for the radiant heating apparatus of FIG. 1.

FIG. 2 illustrates a first embodiment of a fuel supply system that is capable of supplying high pressure gaseous fuel necessary for heating unit 30.

The first fuel supply system consists of a propane tank 50 from which liquid propane is drawn off by a pump 52 through a supply pipe 51 to a vaporizer 56. The propane gas from the output of vaporizer 56 passes through a control regulator 58 where its pressure is reduced from 100 psi to between 30 and 80 psi, as indicated by a gauge 62. The propane gas continues through supply line 42 into heater unit 30. Liquid propane at a pressure above 100 psi is returned to propane tank 50 through a liquid return pipe 55 by a by-pass valve 54.

Figure 3:
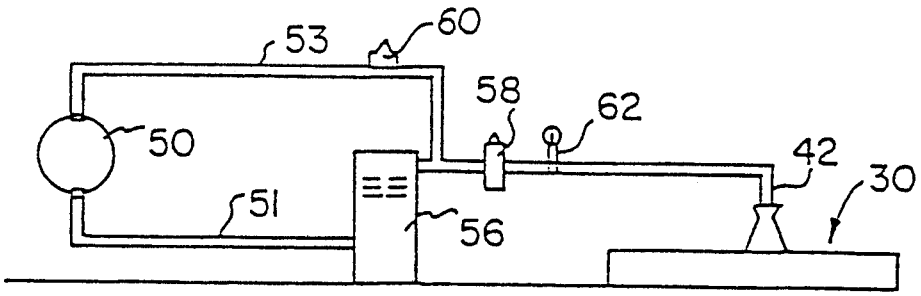
FIG. 3 is a schematic diagram of a second embodiment of a fuel supply system for the radiant heating apparatus of FIG. 1.

FIG. 3 illustrates a second embodiment of the fuel supply system, which does not require the use of a pump, but is capable of supplying fuel to heating unit 30.

The second fuel supply system consists of propane tank 50 from which liquid propane is fed, by gravity, through supply pipe 51 into vaporizer 56. A portion of the vaporized propane gas at the output of vaporizer 56 passes through a regulator 60, set at 100 psi, and returns into propane tank 50 through a vapour return pipe 53. The regulator 60 will shut-off automatically when the pressure of the propane gas has reached 100 psi. Consequently, the liquid propane is forced into pipe 51 by the high pressure gaseous propane at the top of tank 50. If the pressure of the gaseous propane drops below 100 psi regulator 60 is opened to force additional liquid propane into supply pipe 51, which will eventually return the pressure of the vaporized propane gas to 100 psi.

A majority of gaseous propane from the output of vaporizer 56 is passed through control regulator 58, which reduces the pressure of the gaseous propane from 100 psi to between 30 and 80 psi, as indicated by gauge 62. The propane gas continues through supply line 42 into heater unit 30.

These high volume suppliers do not require the use of large blowers since the air is mixed with the high pressure propane in venturi 44 and chamber 40. This provides the necessary 100% premix, of air and gas, to ensure efficient combustion.

I claim:

1. A radiant heating unit comprising:

a) supply means for supplying a quantity of high pressure gaseous fuel at a predetermined pressure;

b) a housing having an open bottom, an upper chamber communicating with said open bottom, and an upper aperture communicating with said upper chamber;

c) first mesh retaining means covering said open bottom;

d) a layer of ceramic wool resting on said first mesh retaining means and substantially covering said open bottom, said layer of ceramic wool having a bottom outer surface;

e) second mesh retaining means covering said open bottom and resting on said layer of ceramic wool;

f) fuel-air mixture means located above and connected to said upper aperture and connected to said supply means for providing a 100% combustible mixture to said upper chamber, said 100% combustible mixture passing through said layer of ceramic wool, and burning at said bottom outer surface of said layer of ceramic wool, said fuel-air mixture means comprising:

g) venturi means in communication with outside air; and h) orifice means located within said venturi means and connected to said supply means, wherein said gaseous fuel passing through said venturi means draws sufficient outside air through said venturi means to mix with said gaseous fuel to provide said 100% combustible mixture.

2. The radiant heating unit of claim 1, wherein said high pressure fuel supply means comprises:

a) a propane tank for storing liquid propane having a supply pipe and a return pipe;

b) a pump connected to said supply pipe and having an outlet pipe;

c) a vaporizer having an input connected to said outlet pipe and an output for gaseous propane;

d) a by-pass valve connected between said outlet pipe and said return pipe for controlling the pressure of the liquid propane at a predetermined maximum at the input to said vaporizer; and e) a control regulator connected to the output of said vaporizer to control the pressure of the gaseous propane to said predetermined pressure.

3. The radiant heating unit of claim 1, wherein said high pressure fuel supply means comprises:

g) a propane tank for storing liquid propane having a supply pipe and a return pipe;

h) a vaporizer having an input connected to said supply pipe and an output for gaseous propane;

j) a first control regulator connected between said output of said vaporizer and said return pipe of said propane tank, wherein said first control regulator regulates the return flow of pressurized propane gas to said propane tank; and k) a second control regulator connected to the output of said vaporizer to control the pressure of the gaseous propane to said predetermined pressure.

4. The radiant heating unit of claim 1, wherein said predetermined pressure is between 30 and 80 psi.

5. A high pressure supply means for supplying and vaporizing a combustible gaseous fuel at a predetermined pressure, said fuel supply means comprising:

a) a propane tank for storing liquid propane having a supply pipe and a return pipe;

b) a pump connected to said supply pipe and having an outlet pipe;

c) a vaporizer having an input connected to said outlet pipe and an output for gaseous propane;

d) a by-pass valve connected between said outlet pipe and said return pipe for controlling the pressure of the liquid propane at a predetermined maximum at the input to said vaporizer; and e) a control regulator connected to the output of said vaporizer to control the pressure of the gaseous propane to said predetermined pressure.

6. A high pressure supply means for supplying and vaporizing a combustible gaseous fuel at a predetermined pressure, said fuel supply means comprising:

a) a propane tank for storing liquid propane having a supply pipe and a return pipe;

b) a vaporizer having an input connected to said supply pipe and an output for gaseous propane;

c) a first control regulator connected between said output of said vaporizer and said return pipe of said propane tank, wherein said first control regulator regulates the return flow of pressurized propane gas to said propane tank; and d) a second control regulator connected to the output of said vaporizer to control the pressure of the gaseous propane to said predetermined pressure.

7. The high pressure fuel supply means of claim 5 or 6, wherein said predetermined pressure is between 30 and 80 psi.

* * * * *